United States Patent [19]

Skogen

[11] 4,252,374

[45] Feb. 24, 1981

[54] DETERMINING THE LOCUS OF A PROCESSING ZONE IN AN OIL SHALE RETORT BY SHALE OIL COMPOSITION

[75] Inventor: Haven S. Skogen, Grand Junction, Colo.

[73] Assignee: Occidental Oil Shale, Inc., Grand Junction, Colo.

[21] Appl. No.: 54,197

[22] Filed: Jul. 2, 1979

[51] Int. Cl.[3] ..... E21C 41/10

[52] U.S. Cl. ..... 299/1; 23/230 EP; 166/251; 166/254; 299/2

[58] Field of Search ..... 299/1, 2; 166/251, 254; 23/230 EP

[56] References Cited

U.S. PATENT DOCUMENTS

| | | | |
|---|---|---|---|
| 4,166,721 | 9/1979 | Cha | 23/230 ED |
| 4,166,722 | 9/1979 | Cha | 299/2 |

*Primary Examiner*—William F. Pate, III
*Attorney, Agent, or Firm*—Arnold Grant

[57] ABSTRACT

A processing zone advances through a fragmented permeable mass of particles containing oil shale in an in situ oil shale retort in a subterranean formation containing oil shale. The retort has shale oil passing therefrom. The shale oil contains a constituent which is carried from the formation by advancement of the processing zone through the fragmented mass. To determine the locus of the processing zone, the formation is first assayed at selected locations in the retort for content of the constituent before processing the selected locations, and, during processing, shale oil from the retort is monitored for concentration of the constituent.

Preferred constituents are the heavy metals such as iron, vanadium, and arsenic.

21 Claims, 1 Drawing Figure

Figure 1:
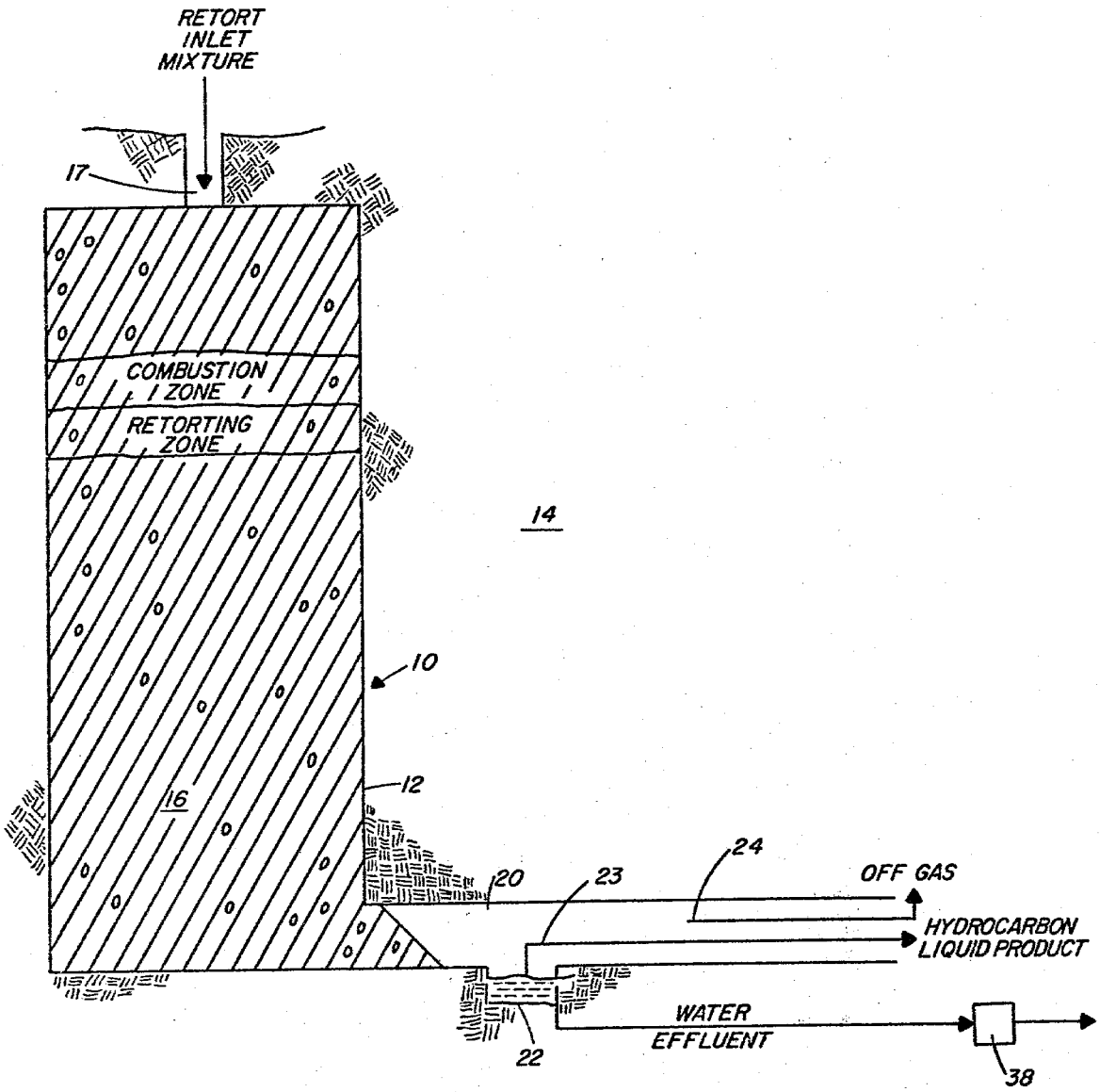

DETERMINING THE LOCUS OF A PROCESSING ZONE IN AN OIL SHALE RETORT BY SHALE OIL COMPOSITION

BACKGROUND

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit having layers containing an organic polymer called "kerogen", which upon heating decomposes to produce hydrocarbon liquid and gaseous products. It is the formation containing kerogen that is called "oil shale" herein, and the liquid hydrocarbon product is called "shale oil".

A number of methods have been proposed for processing oil shale which involve either first mining the kerogen bearing shale and processing the shale above ground, or processing the oil shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application, and incorporated herein by this reference. This patent describes in situ recovery of liquid and gaseous hydrocarbon materials from a subterranean formation containing oil shale by mining out a portion of the subterranean formation and then fragmenting a portion of the remaining formation to form a stationary, fragmented permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen containing retort inlet mixture into the retort as a gaseous combustion zone feed to advance the combustion zone through the retort. In the combustion zone oxygen in the combustion zone feed is depleted by reaction with hot carbonaceous materials to produce heat and combustion gas. By the continued introduction of the gaseous combustion zone feed into the combustion zone, the combustion zone is advanced through the retort. The combustion zone is maintained at a temperature lower than the fusion temperature of oil shale, which is about 2100° F., to avoid plugging of the retort, and above about 1100° F. for efficient recovery of hydrocarbon products from the oil shale.

The effluent gas from the combustion zone, passes through the fragmented mass in the retort on the advancing side of the combustion zone to heat oil shale in a retorting zone to a temperature sufficient to produce kerogen decomposition, called retorting, in the oil shale to gaseous and liquid products and to a residue of solid carbonaceous material.

As used herein, the term "processing gas" is used to indicate gas which serves to advance a processing zone such as a combustion zone, a retorting zone, or both a retorting zone and combustion zone, through the fragmented mass in an in situ oil shale retort, and includes, but is not limited to, an oxygen supplying gas introduced into a retort for advancing a combustion zone and retorting zone through a retort and a hot retorting gas which can be introduced into a retort or generated in a combustion zone in a retort for advancing a retorting zone through a retort.

The liquid products and gaseous products are cooled by cooler particles in the fragmented mass in the retort on the advancing side of the retorting zone. The liquid hydrocarbon products, together with water produced in or added to the retort, are collected at the bottom of the retort and withdrawn to the surface through an access tunnel, drift or shaft. An effluent gas, referred to herein as off gas, containing combustion gas generated in the combustion zone, gaseous products including methane produced in the retorting zone, carbon dioxide from carbonate decomposition, and any gaseous portion of the combustion zone feed that does not take part in the combustion process is also withdrawn from the bottom of the retort.

There are several reasons why it is desirable to know the locus of parts of the combustion and retorting processing zones as they advance through an in situ oil shale retort. One reason is that by knowing the locus of the combustion zone, steps can be taken to control the orientation or shape of the advancing side of the combustion zone. It is desirable to maintain a combustion zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone, thereby reducing hydrocarbon yield. In addition, with a skewed or warped combustion zone, more cracking of the hydrocarbon products can result. Monitoring the locus of parts of the combustion zone provides information for control of the advancement of the combustion zone to maintain it flat and uniformly perpendicular to the direction of its advancement to obtain high yield of hydrocarbon products.

Another reason that it can be desirable to monitor the locus of the combustion zone is to provide information so the composition of the combustion zone feed can be varied with variations in the kerogen content of oil shale being retorted. Formation containing oil shale includes horizontal strata or beds of varying kerogen content, including strata containing substantially no kerogen, and strata having a Fischer assay of 80 gallons of shale oil per ton of oil shale. If combustion zone feed containing too high a concentration of oxygen is introduced into a region of the retort containing oil shale having a high kerogen content, oxidation of carboneous material in the oil shale can generate so much heat that fusion of the oil shale can result, thereby producing a region of the fragmented mass which cannot be penetrated by retorting gases.

Another reason for monitoring the locus of the combustion and retorting processing zones as they advance through the retort, is to monitor the performance of the retort to determine if sufficient shale oil is being produced for the amount of oil shale being retorted.

Also, by monitoring the locus of the combustion and retorting zones, it is possible to control the advancement of these two zones through the retort at an optimum rate. The rate of advancement of the combustion and retorting zones through the retort can be controlled by varying the flow rate and composition of the combustion zone feed. Knowledge of the locus of the combustion and retorting zones allow optimization of the rate of advancement to produce hydrocarbon products of the lowest cost possible with cognizance of the overall yield, fixed costs, and variable costs of producing the hydrocarbon products.

Thus, it is desirable to provide methods for monitoring advancement of combustion and retorting processing zones through an in situ oil shale retort.

SUMMARY OF THE INVENTION

The present invention concerns a process for determining the locus of a processing zone advancing through a fragmented permeable mass of particles in an in situ oil shale retort in a subterranean formation containing oil shale. The retort has shale oil passing therefrom, containing one or more selected constituents carried from the formation by advancement of the processing zone through the fragmented mass. The method of the present invention comprises determining the content of such constituents in the formation at selected locations in the retort before processing the selected locations and monitoring the shale oil from the retort for the concentration of the selected constituents.

The constituents are preferably heavy metals present in the formation in sufficient quantity to be analyzed and whose concentration varies with the levels in the formation. Particularly preferred are arsenic, vanadium and iron because they are organically bound to the kerogen and to the shale oil after retorting.

DRAWINGS

These and other features, aspects and advantages of the present invention will become more apparent upon consideration of the following description, appended claims, and accompanying drawing which represents schematically in vertical cross section an in situ oil shale retort.

DESCRIPTION

Referring to the FIGURE, an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with fragmentation of the mass of formation particles by blasting by any of a variety of techniques. A desirable technique involves excavating or mining a void within the boundaries of an in situ oil shale retort site to be formed in the subterranean formation and explosively expanding remaining oil shale in the formation toward such a void. Methods of forming an in situ oil shale retort are described in U.S. Pat. Nos. 3,661,423; 4,043,595; 4,043,596; 4,043,597; and 4,043,598. A variety of other techniques can also be used.

The fragmented permeable mass in the retort can have a void fraction of from about 10 to about 30%. By void fraction, there is meant the ratio of the volume of voids or spaces between particles in the fragmented mass to the total volume of the fragmented permeable mass of particles in the retort.

A conduit 17 communicates with the top of the fragmented mass of formation particles. During the retorting operation of the retort 10, a combustion processing zone is established in the retort by ignition of carbonaceous material in oil shale. The combustion zone is advanced through the fragmented mass by introducing an oxygen containing retort inlet mixture into the in situ oil shale retort through the conduit 17 as a combustion zone feed. The retort inlet mixture can be air, or air enriched with oxygen, or air diluted by a fluid such as water, steam, a fuel, recycled off gas, an inert gas such as nitrogen, and combinations thereof. Oxygen introduced to the retort in the retort inlet mixture oxidizes carbonaceous material in the oil shale to produce combustion gas. The combustion processing zone is the portion of the retort where the greater part of the oxygen in the combustion zone feed that reacts with residual carbonaceous material in retorted oil shale is consumed. Heat from the exothermic oxidation reactions, carried by flowing gases, advanced the combustion zone through the fragmented mass of particles.

Combustion gas produced in the combustion zone and any unreacted portion of the combustion zone feed passes through the fragmented mass of particles on the advancing side of the combustion zone to establish a retorting processing zone on the advancing side of the combustion zone. Kerogen in the oil shale is retorted in the retorting zone to produce liquid and gaseous products including methane.

There is an access tunnel, adit, drift 20 or the like in communication with the bottom of the retort. The drift contains a sump 22 in which liquid products 23, including liquid hydrocarbon products and water, are collected to be withdrawn. An off gas 24 containing gaseous products, combustion gas, carbon dioxide from carbonate decomposition, and any gaseous unreacted portion of the combustion zone feed, is also withdrawn from the in situ oil shale retort 10 by way of drift 20. The off gas can contain large amounts of nitrogen with lesser amounts of hydrogen, carbon monoxide, carbon dioxide, methane and higher hydrocarbons, water vapor and hydrogen sulfide. The liquid products and off gas are withdrawn from the retort as effluent fluids.

According to the present invention, the locus of the retorting and/or combustion processing zones can be determined by monitoring the shale oil from the fragmented mass for the concentration of heavy metal constituents which are present in sufficient quantity to be analyzed and whose concentration varies with levels in the formation. This is because the concentration of these constituents in the shale oil being produced correlates with their concentration in the oil shale being processed.

By heavy metals is meant elements having an atomic weight greater than 45. The heavy metal may be present in the kerogen in any of the usual forms such as organometallics, chlorophyll type complexes, porphyrin type complexes, and other unidentified structures and in the shale oil as organometallics soaps, salts, chlorophyll type complexes and porphyrin type complexes. Arsenic, vanadium and iron are particularly preferred for locating the locus of the processing zone because they are organically tied to the kerogen before processing and the shale oil after processing.

Suitable monitoring means, shown diagramatically at 38, for such heavy metals includes atomic absorption, x ray fluorescence, and emission spectroscopy; preferred is atomic absorption.

To take advantage of this correlation, the formation is first assayed at selected elevations in the retort for the content of the selected constituent to develop a histogram of content of such constituents versus elevation in the fragmented mass.

Oil shale typically is horizontally bedded due to the sedimentary nature of oil shale. Layers in the fragmented mass are correlated with strata in the unfragmented formation because there is little vertical mixing between strata when explosively fragmenting particles. Therefore, samples of various strata through the retort can be taken before initiating retorting of the oil shale and assays can be conducted to determine content of the selected components. Such samples can be taken from within the fragmented mass, from formation in the retort site before expansion or from formation nearby the fragmented mass since little change in heavy metal content of oil shale occurs over large areas of formation on the same strata. Thus, by knowing the content of the constituent in the fragmented mass 16 at selected elevations, and by knowing the actual concentration of the selected constituent in the shale oil, the elevation of a processing zone in the retort can be determined.

The heavy concentration of shale oil from an in situ oil shale retort as retorting of the fragmented mass in the retort progresses can be predicted for each day from start-up. This can be done by estimating the advancement rate of the retorting zone through the retort. By predicting the shale oil production rate and the heavy metal concentration of the shale oil as a function of the elevation in the retorting zone, and by estimating the rate of advancement of the retorting zone through the retort, the heavy metal concentration of the shale oil as a function of time from start-up can be predicted. In addition, the total production of shale oil from the retort can be predicted for each day from start-up. By comparing predicted heavy metal concentration against actual heavy metal concentration as retorting progresses, by comparing actual production rate versus predicted production rate, and/or by comparing actual total production versus predicted total production, it is possible to determine if the retorting zone has deviated from its predicted rate of advancement through the fragmented mass.

Not only can the method of this invention be used for determining the elevation of a processing zone in a fragmented permeable mass in a retort and for detecting deviations from a desired or predicted elevation, it can also be used to determine the orientation of the processing zone. If a processing zone is substantially flat and horizontal, it encounters layers of different content of kerogen relatively abruptly. Thus, changes in heavy metal concentration especially in the cases of arsenic, vanadium and iron can clearly be associated with changes in kerogen content. If the retorting zone is skewed or significantly warped, it can encounter several layers of different kerogen content at substantially the same time, thereby tending to obscure the correlation between heavy metal concentration and the location of the retorting zone in the fragmented mass. In essence, the first derivative of the heavy metal concentration as a function of time is reduced when the retorting zone is skewed or non-planar as compared with the first derivative of the heavy metal concentration when the retorting zone is substantially flat and horizontal. Thus, it is possible to determine if the retorting zone is substantially planar and substantially normal to its direction of advancement by comparing the first derivative of determined heavy metal content of the shale oil and heavy metal production rate with the first derivative of predicted heavy metal contact and heavy metal production rate, respectively.

In summary, by monitoring the content in the shale oil of a selected constituent present in and carried from the retort, one can determine not only the location of a processing zone in the retort, but also deviations of the processing zone from its desired shape or orientation.

Although this invention has been described in detail with reference to certain versions thereof, other versions of this invention can be practiced. Therefore, the spirit and scope of the appended claims should not be limited to the description of the preferred versions contained herein.

What is claimed is:

1. A method for determining the locus of a processing zone advancing through a fragmented permeable mass of particles containing oil shale in an in situ oil shale retort in a subterranean formation containing oil shale, the retort having boundaries of unfragmented formation and the retort having shale oil passing therefrom containing at least one selected heavy metal constituent, the selected heavy metal constituent being carried from the formation by advancement of the processing zone through the fragmented mass, the method comprising the steps of:

determining content of at least one heavy metal constituent in formation at selected locations in the retort before processing the selected locations; and monitoring shale oil from the retort for the concentration of the selected heavy metal constituent.

2. The method of claim 1 wherein the selected constituent is selected from the group consisting of arsenic, vanadium and iron.

3. The method of claim 1 wherein the processing zone is a combustion zone.

4. The method of claim 1 wherein the processing zone is a retorting zone.

5. The method of claim 1 wherein the step of determining comprises assaying formation which is outside the boundaries of the retort.

6. The method of claim 1 wherein the step of determining comprises assaying formation which is within the boundaries of the retort.

7. A method for determining the locus of a processing zone advancing through a fragmented permeable mass of particles containing oil shale in an in situ oil shale retort in a subterranean formation containing oil shale, the retort having boundaries of unfragmented formation, the oil shale containing kerogen, the retort having shale oil passing therefrom containing a selected heavy metal constituent organically tied to the kerogen in the oil shale, the method comprising the steps of:

determining kerogen content in formation at selected locations in the retort before processing the selected locations; and monitoring shale oil from the retort for concentration of the selected heavy metal constituent.

8. The method of claim 7 wherein the processing zone is a retorting zone.

9. The method of claim 7 wherein the step of determining comprises assaying formation which is outside the boundaries of the retort.

10. The method of claim 7 wherein the step of determining comprises assaying formation which is within the boundaries of the retort.

11. The method of claim 7 wherein the selected heavy metal constituent is selected from the group consisting of arsenic, vanadium and iron.

12. A method for determining the locus of a processing zone advancing through a fragmented permeable mass of particles containing oil shale in an in situ oil shale retort in a subterranean formation containing oil shale, said retort having shale oil withdrawn therefrom, and said subterranean formation including a plurality of generally horizontal strata having different contents of a selected heavy metal constituent, the method comprising the steps of:

forming an in situ oil shale retort containing a fragmented permeable mass of formation particles containing oil shale in the formation, the fragmented mass containing generally horizontal layers of particles correlated with such strata;

assaying the formation at selected elevations for content of the selected heavy metal constituent in the fragmented mass;

predicting production rates of the selected heavy metal constituent at selected elevations in the fragmented mass;

establishing a processing zone in the fragmented mass;

introducing a processing gas to an upper portion of the fragmented mass for advancing the processing zone downwardly through the fragmented mass and for retorting oil shale in the fragmented mass with generation of the selected constituent;

withdrawing shale oil containing the selected heavy metal constituent from a lower portion of the retort;

monitoring shale oil withdrawn from the fragmented mass for concentration of the selected heavy metal constituent;

determining a production rate of the selected heavy metal constituent from the retort; and comparing such a determined production rate of the selected heavy metal constituent from the retort with such a predicted production rate of the selected heavy metal constituent.

13. The method of claim 12 wherein the comparing step comprises comparing the first derivative of such a determined production rate of the selected heavy metal constituent versus time with the first derivative of such a predicted production rate of the selected heavy metal constituent versus time.

14. The method of claim 12 wherein the selected heavy metal constituent is selected from the group consisting of arsenic, vanadium and iron.

15. A method for determining the locus of a processing zone advancing downwardly through a fragmented permeable mass of particles containing oil shale in an in situ oil shale retort in a subterranean formation containing oil shale, said subterranean formation including a plurality of generally horizontal strata having different kerogen contents comprising the steps of:

forming an in situ oil shale retort containing a fragmented permeable mass of formation particles containing oil shale in the formation, the fragmented mass containing generally horizontal layers of particles correlated with such strata;

assaying kerogen content in layers in the fragmented mass at selected elevations;

predicting production rates of a selected heavy metal constituent in the kerogen content in layers in the fragmented mass;

establishing a processing zone in the fragmented mass;

introducing a processing gas to an upper portion of the fragmented mass for advancing the processing zone downwardly through the fragmented mass and for retorting oil shale therein;

withdrawing shale oil from a lower portion of the fragmented mass;

monitoring shale oil from the fragmented mass for concentration of the selected heavy metal constituent;

determining a production rate of the selected heavy metal constituent from the retort;

comparing such a determined production rate of the selected heavy metal constituent from the retort with such a predicted production rate of the selected heavy metal constituent.

16. The method of claim 15 wherein the processing gas contains oxygen and the processing zone is a combustion zone.

17. The method of claim 15 wherein the comparing step comprises comparing the first derivative of such a determined selected heavy metal constituent production rate versus time with the first derivative of such a predicted selected heavy metal constituent production rate versus time.

18. A method for determining the locus of a processing zone in a fragmented mass in an in situ oil shale retort in a subterranean formation containing oil shale, such an in situ oil shale retort containing a fragmented permeable mass of formation particles containing oil shale, the method comprising the steps of:

determining the content of a component in such formation selected from the group consisting of arsenic, vanadium and iron at a plurality of elevations in the fragmented mass in an in situ oil shale retort;

introducing an inlet gas to an upper portion of the fragmented mass in the in situ oil shale retort;

withdrawing shale oil from a lower portion of the fragmented mass in the in situ oil shale retort, the shale oil containing said component;

predicting production of the said component in the shale oil withdrawn from the fragmented mass as a function of the component content of the formation at least one elevation in the fragmented mass;

measuring concentration of the said component in shale oil withdrawn from the fragmented mass;

measuring shale oil production rate;

determining production of the said component; and comparing determined production of the said component with predicted production of the said component for at least one elevation in the fragmented mass.

19. The method of claim 18 wherein the selected component is arsenic.

20. A method for determining if a processing zone advancing through a fragmented permeable mass of particles containing oil shale in an in situ oil shale retort in a subterranean formation containing oil shale is substantially planar and substantially normal to its direction of advancement through the fragmented mass, the retort having shale oil gas passing therefrom containing a selected heavy metal constituent, carried from the formation by advancement of the processing zone through the fragmented mass, the method comprising the steps of:

(a) determining content of such selected heavy metal constituent in the formation at selected locations in the retort before processing the selected locations;

(b) predicting the first derivative of the production rate of the selected heavy metal constituent versus time for such selected locations;

(c) monitoring shale oil from the retort for concentration of the selected heavy metal constituent;

(d) determining the rate at which shale oil passes from the retort;

(e) determining production rate of the selected heavy metal constituent;

(f) determining the first derivative of the production rate of the selected heavy metal constituent in the shale oil versus time; and (g) comparing such a determined first derivative with such a predicted first derivative.

21. The method of claim 20 wherein the selected heavy metal constituent is selected from the group consisting of arsenic, vanadium and iron.

* * * * *